US009995091B2

(12) United States Patent
Bu et al.

(10) Patent No.: US 9,995,091 B2
(45) Date of Patent: Jun. 12, 2018

(54) ROCK DRILL TELESCOPIC ARM AND ROCK DRILL

(71) Applicant: ATLAS COPCO (NANJING) CONSTRUCTION AND MINING EQUIPMENT LTD., Nanjing, Jiangsu (CN)

(72) Inventors: Dongliang Bu, Jiangsu (CN); Jianming Shi, Jiangsu (CN); Per Elven, Jiangsu (CN); Mats Hedenborg, Jiangsu (CN); Zhongxi Zhou, Jiangsu (CN); Yucang Zheng, Jiangsu (CN)

(73) Assignee: EPIROC (NANJING) CONSTRUCTION AND MINING EQUIPMENT CO., LTD. (CN)

( * ) Notice: Subject to any disclaimer, the term of this patent is extended or adjusted under 35 U.S.C. 154(b) by 260 days.

(21) Appl. No.: 14/898,911

(22) PCT Filed: Jun. 18, 2014

(86) PCT No.: PCT/CN2014/080231
§ 371 (c)(1),
(2) Date: Dec. 16, 2015

(87) PCT Pub. No.: WO2014/202006
PCT Pub. Date: Dec. 24, 2014

(65) Prior Publication Data

US 2016/0145950 A1 May 26, 2016

(30) Foreign Application Priority Data

Jun. 19, 2013 (CN) ..... 2013 1 0245700

(51) Int. Cl.
*E21B 17/07* (2006.01)
*E21B 7/02* (2006.01)

(52) U.S. Cl.
CPC ..... *E21B 17/07* (2013.01); *E21B 7/025* (2013.01)

(58) Field of Classification Search
CPC ..... E21B 17/07; E21B 7/025
See application file for complete search history.

(56) References Cited

U.S. PATENT DOCUMENTS 2,958,514 A * 11/1960 Lee ..... E21B 7/022 173/147
3,150,723 A * 9/1964 Hale ..... E21B 19/084 173/147

(Continued)

FOREIGN PATENT DOCUMENTS

CN 201598975 U 10/2010
CN 102001591 A 4/2011

(Continued)

OTHER PUBLICATIONS

PCT International Search Report for PCT/CN2014/080231 dated Aug. 22, 2014.

*Primary Examiner* — James G Sayre
(74) *Attorney, Agent, or Firm* — Carter, DeLuca, Farrell & Schmidt, LLP

(57) ABSTRACT

A rock drill telescopic arm is provided having a fixed arm which is sleeved on a movable arm; a telescopic oil cylinder; a plurality of adjusting blocks in the fixed arm along a circumferential direction thereof; a plurality of adjusting screw rods for respectively adjusting the position of each of the adjusting blocks on the fixed arm; a wear-resistant sliding block between at least part of the adjusting blocks and the movable arm; and a retainer at an opening end of the fixed arm for preventing the wear-resistant sliding block from moving along a telescoping direction of the movable arm, wherein the movable arm can be driven by the telescopic oil cylinder to slide along the wear-resistant sliding (Continued)

block. A rock drill equipped with the rock drill telescopic arm provides for convenient adjustment of a gap between the fixed arm and the movable arm.

8 Claims, 3 Drawing Sheets

(56) References Cited

U.S. PATENT DOCUMENTS 3,209,842 A * 10/1965 Meyer ..... E21B 7/024 173/193
3,304,033 A * 2/1967 Thompson ..... E21B 7/025 173/195
3,306,374 A * 2/1967 Stromnes ..... E21B 7/025 173/193
3,563,321 A * 2/1971 Barendsen ..... E21B 7/022 173/194
3,684,035 A * 8/1972 Wills ..... E21B 7/025 173/147
3,868,076 A * 2/1975 Beagan, Jr. ..... E21B 7/025 173/193
4,697,648 A * 10/1987 Brandt ..... E21B 19/087 173/162.1
5,129,464 A * 7/1992 Richier ..... E21B 7/022 173/1
5,746,277 A * 5/1998 Howell, Jr. ..... E21B 3/04 173/147

FOREIGN PATENT DOCUMENTS

| | | | |
|---|---|---|---|
| CN | 202880797 | * | 4/2013 |
| CN | 202880797 U | | 4/2013 |
| CN | 103382811 A | | 11/2013 |
| CN | 103438189 A | | 12/2013 |
| CN | 203476216 U | | 3/2014 |
| RU | 95109323 A | | 7/1996 |

* cited by examiner

ROCK DRILL TELESCOPIC ARM AND ROCK DRILL

TECHNICAL FIELD

The present invention relates to the field of a rock drill, and particularly to a rock drill telescopic arm and a rock drill equipped with the same.

BACKGROUND ART

A rock drill is a construction machine for operation of drilling blast holes in open-pit mining operation, and it mainly comprises a running gear, a frame, a power system, a rock drilling mechanism, an arm support mechanism, a dust removal mechanism, an electric control system, and so on. The arm support mechanism is a device for connecting the rock drilling mechanism with the frame, and supports the entire rock drilling mechanism. It is possible to adjust the position of the rock drilling mechanism through the action of the arm support mechanism, so as to realize drilling operation in different locations and states. The arm support mechanism can be classified into three types: a single arm, a telescopic arm, and a folding arm. As shown in FIG. 1, the conventional telescopic arm comprises a fixed arm 11, a movable arm 13 and a telescopic oil cylinder 12; the fixed arm 11 is sleeved on the movable arm 13, and the movable arm 13 is driven by the telescopic oil cylinder 12 to slide within the fixed arm 11, thereby realizing the telescopic action. Typically, four sliding blocks 16 are mounted on four surfaces of the outer side of the tail of the movable arm 13, and four sliding blocks 14 are mounted on the four surfaces of the inner side of the opening portion of the fixed arm 11. The sliding blocks 16 mounted on the movable arm slide along the inner side of the fixed arm 11, and the sliding blocks 14 mounted on the fixed arm enable the movable arm to conveniently slide along the inner side of the fixed arm. Adjusting pads 15 and 17 for controlling the height of the sliding blocks are provided between the sliding blocks and the movable arm and between the sliding blocks and the fixed arm so as to guarantee the gap between the movable arm and the fixed arm.

The telescopic arm of this structure has the following problems during the process of assembly and use:

(1) With the influence of manufacturing errors of the movable arm and the fixed arm, in order to ensure the movable arm to smoothly stretch and retract along the fixed arm, adjusting pads of different thicknesses need to be additionally mounted when the movable arm and the fixed arm are assembled, so that the gap between the sliding blocks and the movable arm and the gap between the sliding blocks and the fixed arm are uniform. However, such adjustment cannot be easily carried out in assembly, and it requires many times of trial assembly and thus takes time and effort.

(2) When the sliding blocks are worn, the gaps are enlarged, so it needs to completely disassemble the movable arm and the fixed arm and increase the adjusting pads or replace the sliding blocks. Therefore, the assembling and disassembling work are complicated.

SUMMARY OF INVENTION

In order to solve the above problems, the present invention provides a rock drill telescopic arm and a rock drill equipped with the same, so that the gap between the movable arm and fixed arm is uniform and can be conveniently adjusted, and the adjusting blocks and the wear-resistant sliding blocks can be easily replaced.

To achieve the above objects, the rock drill telescopic arm of the present invention comprises a fixed arm, a movable arm, and a telescopic oil cylinder. The fixed arm is sleeved on the movable arm; a plurality of adjusting blocks are provided in the fixed arm along a circumferential direction thereof; a plurality of adjusting screw rods for respectively adjusting the position of each of the adjusting blocks are provided on the fixed arm; a wear-resistant sliding block is provided between at least part of the plurality of adjusting blocks and the movable arm; a retainer for preventing the wear-resistant sliding block from moving along a telescoping direction of the movable arm is provided at an opening end of the fixed arm; the movable arm can be driven by the telescopic oil cylinder to slide along the wear-resistant sliding block.

Preferably, the retainer and the opening end of the fixed arm are detachably connected.

Preferably, said at least part of the adjustment blocks are provided at positions close to the opening end of the fixed arm.

Preferably, a cover plate is fixed to the fixed arm, and the adjusting screw rods are provided on the cover plate.

Preferably, a plurality of wear-resistant sliding blocks are provided at positions close to the tail of the movable arm along a circumferential direction thereof.

A rock drill is equipped with the rock drill telescopic arm of any one of the above aspects.

With the rock drill telescopic arm and the rock drill of the present invention, by adjusting the position of the adjusting block with the adjusting screw rod on the fixed arm, the gap between the fixed arm and the movable arm can be adjusted and the concentricity thereof is guaranteed, so that the movable arm can stretch and retract smoothly within the fixed arm, ensuring the normal operation of the rock drill telescopic arm. With this kind of structure, the gap can be adjusted conveniently and can be adjusted to be uniform. Meanwhile, since part of the adjusting blocks and the wear-resistant sliding blocks are provided at positions close to the opening end of the fixed arm, the dimension of the retainer may be shortened, enabling the part of the adjusting blocks and the wear-resistant sliding blocks more conveniently disassembled and assembled, and easily replaced.

SPECIFIC MODE FOR CARRYING OUT THE INVENTION

Figure 1:
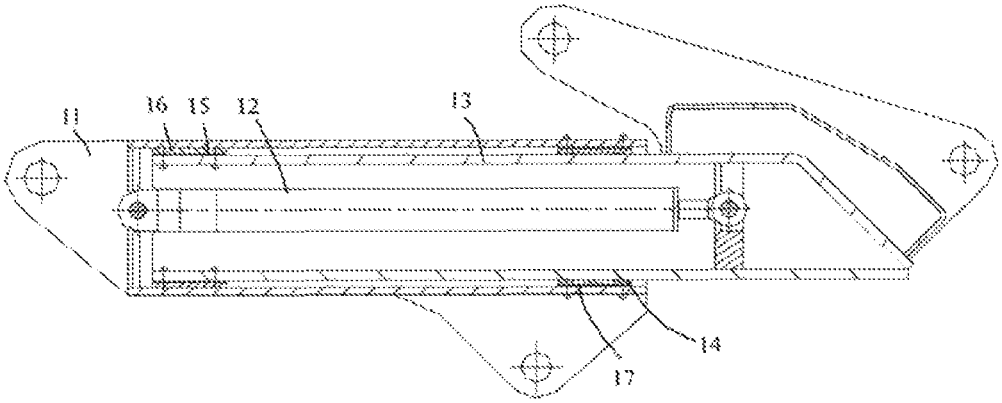
FIG.1 (PRIOR ART)
FIG. 1 is a schematic diagram of the rock drill telescopic arm in the prior arts.
Figure 2:
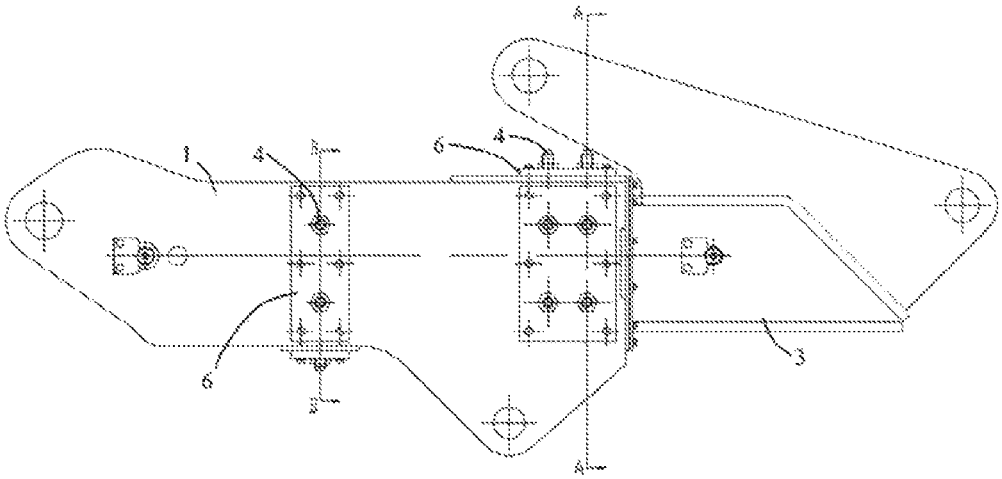
FIG. 2 is a schematic diagram of the rock drill telescopic arm of the present invention.
Figure 3:
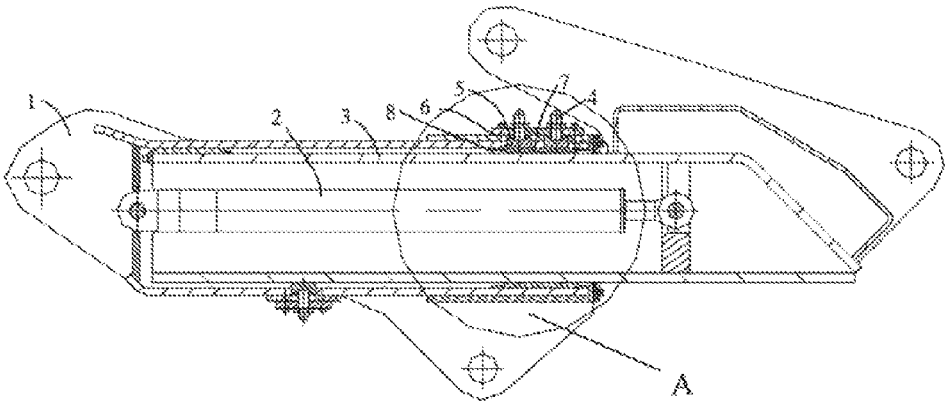
FIG. 3 is a structural schematic diagram of the rock drill telescopic arm of the present invention.
Figure 4:
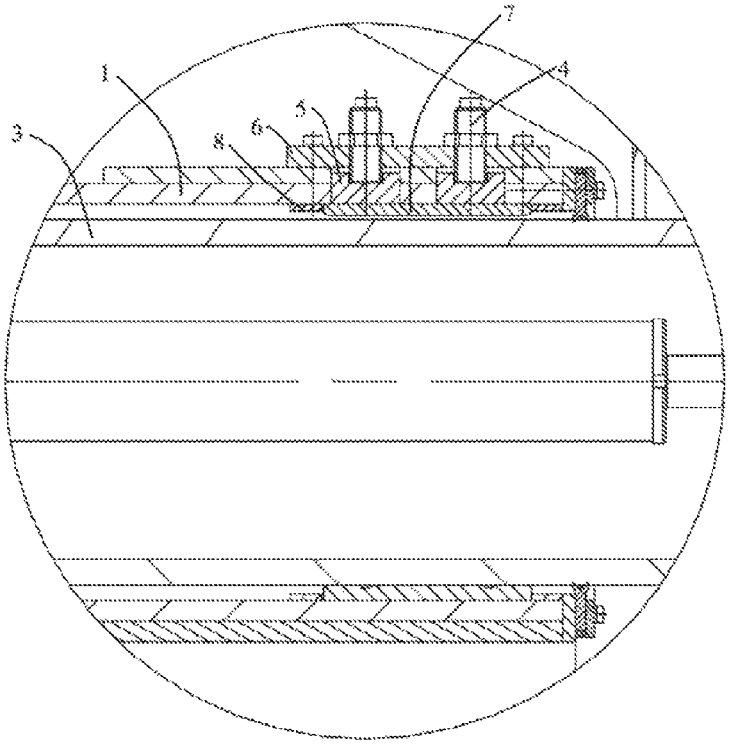
FIG. 4 is a partial enlarged view of part A in FIG. 3.
Figure 5:
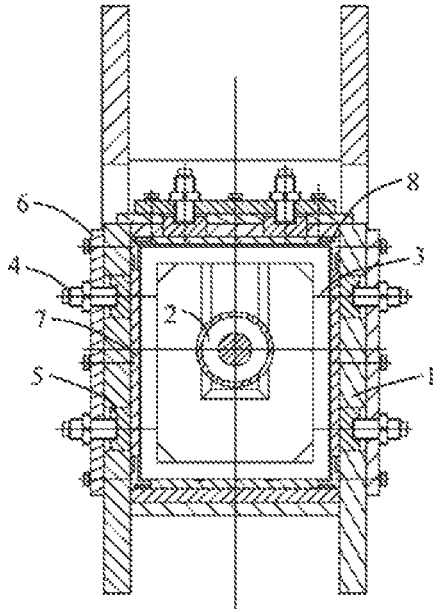
FIG. 5 is an enlarged sectional view in A-A direction in FIG. 2.
Figure 6:
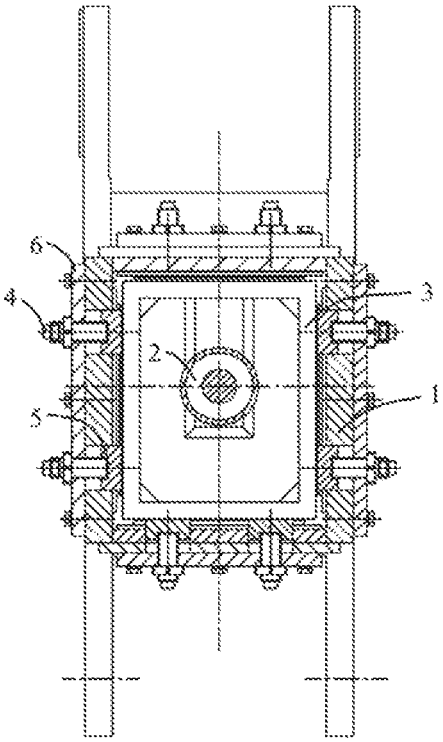
FIG. 6 is an enlarged sectional view in B-B direction in FIG. 2.

As shown in FIGS. 2-6, the rock drill telescopic arm of the present invention comprises a fixed arm 1, a movable arm 3 and a telescopic oil cylinder 2. The fixed arm 1 is sleeved on the movable arm 3; a plurality of adjusting blocks 5 are provided in the fixed arm 1 along a circumferential direction thereof; a plurality of adjusting screw rods 4 for respectively adjusting the position of each of the adjusting blocks 5 are provided on the fixed arm 1. The adjusting screw rods 4 can be directly threaded-connected with the fixed arm 1 and the adjusting blocks 5, or a cover plate 6 can be provided on the fixed arm 1 and the adjusting screw rods 4 can be threaded-connected with the cover plate 6 and the adjusting blocks 5. By the latter connecting means, the fixed arm 1 is provided with a hole having a dimension that is slightly larger than that of the adjusting block 5, which makes the assembly, disassembly and position adjustment of the adjusting blocks 5 convenient; namely, the adjusting blocks 5 can be replaced simply by disassembling the cover plate 6, without disassembling the entire fixed arm 1, as shown in FIG. 4. A wear-resistant sliding block 7 is provided between at least part of the plurality of adjusting blocks 5 and the movable arm 3, and a retainer 8 for preventing the wear-resistant sliding block 7 from moving along the telescoping direction of the movable arm 3 is provided at the opening end of the fixed arm 1 (taking the end for fitting the movable arm as the opening end of the fixed arm 1); the wear-resistant sliding block 7 is position-limited along the telescoping direction of the movable arm 3 by the retainer 8.

The retainer 8 is a frame which can surround the periphery of the wear-resistant sliding block 7. The retainer 8 is fixed to the fixed arm 1, so as to prevent the movable arm 3 from driving the wear-resistant sliding block 7 to move during the telescopic movement. At the same time, the wear-resistant sliding block 7 can move to the side close to the movable arm 3 as well as the side away from the movable arm 3.

For the convenience of removing the wear-resistant sliding block 7, the retainer 8 and the opening end of the fixed arm 1 are detachably connected, such as by means of threaded-connection. Said at least part of the adjusting blocks 5 may be provided at the positions close to the opening end of the fixed arm 1, so that the dimension of the retainer 8 can be shortened, and the wear-resistant sliding block 7 on the retainer 8 can be conveniently removed.

By the coordination of the adjusting screw rods 4 and the adjusting blocks 5 in use, when the adjusting screw rods 4 are adjusted, the adjusting blocks 5 can appropriately adjust the position of the movable arm 3 in the fixed arm 1, so that the fixed arm 1 and the movable arm 3 are concentric, so that the movable arm 3 can stretch and retract easily. When the telescopic oil cylinder 2 drives the movable arm 3 to slide, the movable arm 3 slides along the wear-resistant sliding block 7 in the fixed arm 1, realizing the stretching or retracting of the movable arm 3 and thus completing the rock drilling operation.

To further facilitate the movable arm 3 to slide in the fixed arm 1, an adjusting block 5 may also be disposed in a middle position of the fixed arm 1, so that the movable arm 3 can slide along the adjusting block 5 and the above mentioned wear-resistant sliding blocks, improving the sliding smoothness of the movable arm 3. Of course, the adjusting blocks 5 can be provided at a plurality of places in longitudinal direction and a circumferential direction of the fixed arm 1, so as to further improve uniformity of the gap adjustments between the fixed arm 1 and the movable arm 3.

Similarly, in order to make the movable arm 3 slide conveniently, a plurality of wear-resistant sliding blocks 7 are provided at the positions close to the tail of the movable arm 3 (when the movable arm 3 works, the end thereof stretching out of the fixed arm 1 is taken as the head, and the end thereof in the fixed arm 1 is taken as the tail) along a circumferential direction thereof.

When using the rock drill telescopic arm of the present invention, the gaps between the movable arm 3 and the fixed arm 1 are adjusted by the adjusting screw rods 4, so that the fixed arm 1 and the movable arm 3 are concentric and the movable arm 3 slides within the fixed arm 1. The wear-resistant sliding blocks 7 which are in the fixed arm 1 and at the positions close to the stretching end of the movable arm 3, and the wear-resistant sliding blocks 7 which are at the positions close to the tail of the movable arm 3 can further facilitate the movable arm 3 to slide smoothly. Meanwhile, the adjusting blocks 5 and the wear-resistant sliding blocks 7 which are in the fixed arm 1 and at the positions close to the stretching end of the movable arm 3 can be easily disassembled, assembled and replaced, and thus can be conveniently maintained.

In addition, the present invention also includes a rock drill comprising the above mentioned rock drill telescopic arm. With the rock drill using the telescopic arm, the gap in the telescopic arm can be easily adjusted, and the adjusting blocks 5 can be easily replaced.

The invention claimed is:

1. A rock drill telescopic arm comprising:

a fixed arm;

a movable arm, the fixed arm being sleeved on the movable arm;

a telescopic oil cylinder;

a plurality of adjusting blocks in the fixed arm along a circumferential direction thereof;

a plurality of adjusting screw rods for respectively adjusting a position of each of the plurality of adjusting blocks on the fixed arm;

a wear-resistant sliding block between at least part of the plurality of adjusting blocks and the movable arm;

a cover plate fixed to the fixed arm, the plurality of adjusting screw rods provided on the cover plate; and a retainer at an opening end of the fixed arm for preventing the wear-resistant sliding block from moving along a telescoping direction of the movable arm;

wherein the movable arm is driven by the telescopic oil cylinder to slide along the wear-resistant sliding block.

2. The rock drill telescopic arm according to claim 1, wherein the retainer is detachably connected to the opening end of the fixed arm.

3. A rock drill configured and dimensioned for being equipped with the rock drill telescopic arm according to claim 2.

4. The rock drill telescopic arm according to claim 1, wherein at least part of the plurality of adjusting blocks are provided at positions close to the opening end of the fixed arm.

5. A rock drill configured and dimensioned for being equipped with the rock drill telescopic arm according to claim 4.

6. The rock drill telescopic arm according to claim 1, wherein a plurality of wear-resistant sliding blocks are provided at positions close to a tail of the movable arm along a circumferential direction thereof.

7. A rock drill configured and dimensioned for being equipped with the rock drill telescopic arm according to claim 6.

8. A rock drill configured and dimensioned for being equipped with the rock drill telescopic arm according to claim 1.

* * * * *